United States Patent [19]

Siller

[11] 4,257,831

[45] Mar. 24, 1981

[54] PROCESS FOR THE CONTINUOUS HARDENING OF PUMP CASINGS

[76] Inventor: Vinzenz Siller, Swartenhorst 3, 2000 Hamburg 71, Fed. Rep. of Germany

[21] Appl. No.: 914,968

[22] Filed: Jun. 12, 1978

[51] Int. Cl.[3] ..... C21D 1/08; C21D 9/08

[52] U.S. Cl. ..... 148/134; 148/146; 148/151; 148/152

[58] Field of Search ..... 148/145, 146, 151, 152, 148/134; 266/121, 123, 127, 261; 417/900, DIG. 1; 432/224

[56] References Cited

U.S. PATENT DOCUMENTS

| | | | |
|---|---|---|---|
| 2,318,145 | 5/1943 | Emery et al. | 148/16.5 |
| 3,385,583 | 5/1968 | Jablonski | 266/124 |
| 3,887,328 | 6/1975 | Maddock | 266/261 |
| 4,030,711 | 6/1977 | Siller | 148/151 |

FOREIGN PATENT DOCUMENTS

| | | | |
|---|---|---|---|
| 2438800 | 2/1976 | Fed. Rep. of Germany | 148/151 |
| 2445678 | 4/1976 | Fed. Rep. of Germany | 266/261 |

*Primary Examiner*—L. Dewayne Rutledge
*Assistant Examiner*—Peter K. Skiff
*Attorney, Agent, or Firm*—Toren, McGeady and Stanger

[57] ABSTRACT

The invention relates to an economic process and apparatus for the continuous hardening of pump casings by means of flame hardening, with or without modifications to the core characteristics. As a result the life of the thus treated pump casing is considerably increased, even if it is exposed to a high degree of wear. This is achieved in that the horizontally positioned pump casing is moved past the flame hardening apparatus about a vertical axis and is simultaneously moved out of the horizontal position in such a way that the cooling water is removed over the already hardened inner wall surface.

6 Claims, 5 Drawing Figures

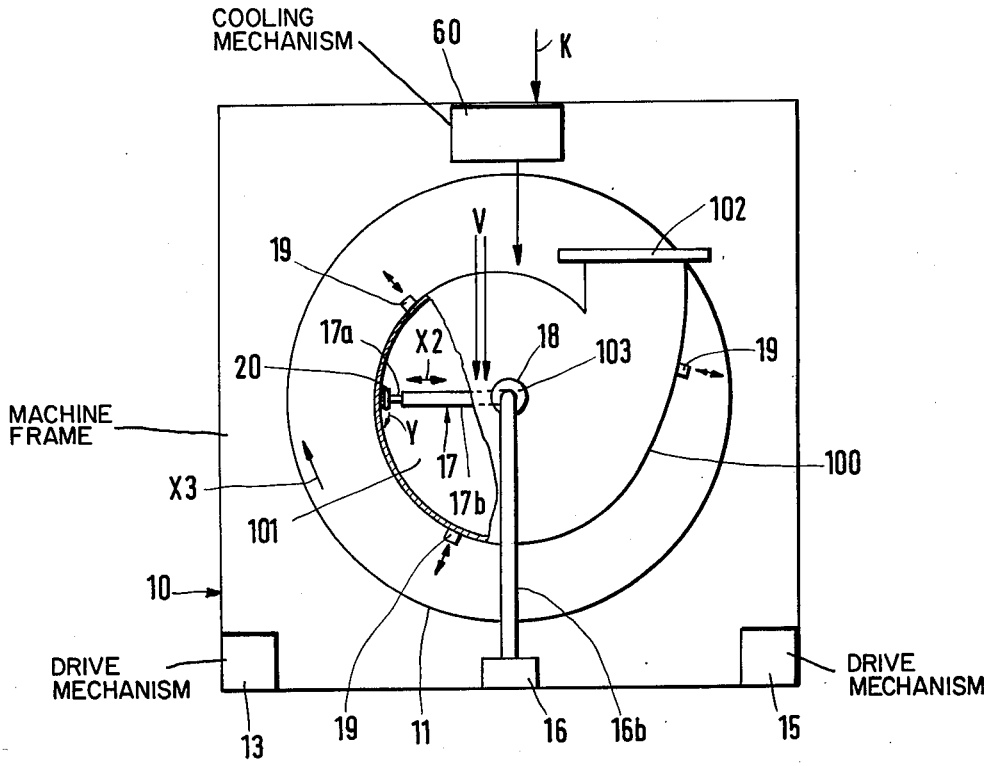
Fig. 1
Fig. 2
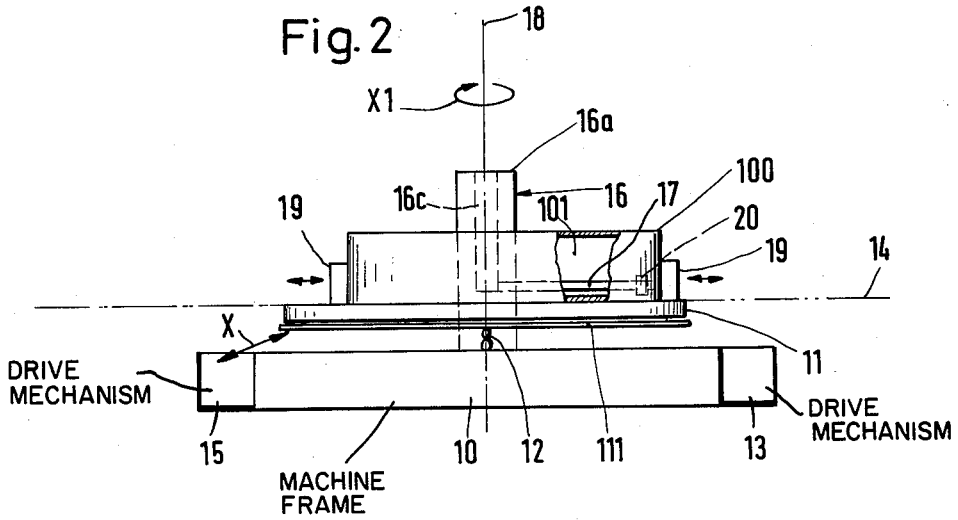

PROCESS FOR THE CONTINUOUS HARDENING OF PUMP CASINGS

BACKGROUND OF THE INVENTION

The invention relates to a process and to an apparatus for the continuous hardening of pump casings which may or may not have an inner plating and with or without modifying the core characteristics by subjecting the inner surface of the casing to the action of a flame hardening apparatus.

Armoured pump casings are mainly made from cast steel. Wearing plates are not provided on the inside of such pump casings and repairs are carried out by welding the casing.

The casing for the pump system is constructed by fitting a cast casing into an outer sheet metal shell, which is split and whose two shell parts are screwed together. This casing is less expensive, because it does not have the otherwise necessary static ribbing and casing base. However, the prime costs for such pump systems are considerably higher.

In the case of large pumps, which are for example used in wet dredgers the inside of the pump casing is lined with wearing plates, i.e. internal plating is provided. Steel having a C-content of 0.12 to 0.8% is generally used for this purpose. The thickness of the wearing plates is dependent on the degree of wear and is laid down by the dredger companies, varying between 10 and 40 mm. As they are not hardened the hardness of the wearing plates is max. 20 MRC. In the case of one shift operation the internal plating has to be replaced two or three times yearly. However, as a function of the hydraulic packing material this figure may be increased or decreased.

BRIEF SUMMARY OF THE INVENTION

The problem of the present invention is to provide an economic process and apparatus for flame hardening of pump casings, particularly those having an internal plating, so that the life of the thus treated pump casing is increased, even if it is exposed to high wear.

This problem is solved by a process for the continuous hardening of pump casings by means of a flame hardening apparatus in which the core characteristics of the material may or may not be modified in which the horizontally positioned pump casing is moved past the flame hardening apparatus about its vertical axis and is simultaneously moved out of the horizontal position in such a way that the cooling water is removed via the already hardened inner wall surface.

According to the invention the apparatus for performing this process has a flame hardening apparatus with a flame hardening burner arranged in the inner area of the pump casing, a supporting disc arranged horizontally in a machine casing, which can be caused to rotate by means of a drive mechanism and which can be pivoted about the horizontal by a further drive mechanism, and retaining devices arranged on the supporting disc and receiving the pump casing.

The invention also provides a process for the continuous hardening of pump casings by means of a flame hardening apparatus, with or without modification to the core characteristics of the material, in which the flame hardening apparatus is moved past the inner wall of the horizontally arranged fixed pump casing and the latter is swung out of the horizontal position in such a way that the cooling water is removed over the already hardened inner surface.

According to the invention the apparatus for performing this process has a flame hardening apparatus with a flame hardening burner arranged in the inner area of the pump casing and which can be moved in a circular path by means of a drive mechanism, a supporting disc arranged horizontally in a machine casing and pivotable about its horizontal plane by means of a further drive mechanism and retaining devices arranged on the supporting disc which receive the pump casing.

According to the invention the set problem is solved by a process for the continuous hardening of pump casings by means of a flame hardening apparatus, with or without modification to the core characteristics of the material in which the flame hardening apparatus is moved upwards along one side of the inner wall of the vertically positioned pump casing from the lowest point to the highest point, is switched off, is returned to the lowest point and then after switching on again is moved along the other side up to the highest point.

The apparatus for performing this process has a machine frame with devices for supporting the pump casing in the vertical position, two arm-like bearing supports spaced from one another on either side of the pump casing, a drivable shaft mounted in the same with a swivel arm fixed thereto and which carries on its free end the flame hardening apparatus with a flame hardening burner.

Further advantageous developments of the process and apparatus according to the invention can be gathered from the remaining subclaims. Of particular advantage is the development in which the retaining or swivel arms carrying the flame hardening apparatus are constructed so as to be automatically lengthwise adjustable because pump casings are not constructed in a symmetrical manner so that it is necessary that the flame hardening apparatus with the flame hardening burner is always moved past at a uniform distance from the inner wall surface of the pump casing.

The flame hardening process for the continuous surface hardening of the inner surface of pump casings with or without internal plating and the apparatus constructed for this ensure the completely satisfactory internal hardening of pump casings. Thus, the pump casings can be hardened from the inside because the flame hardening apparatus is moved slowly along the inner wall surface of the pump casing for the performance of the internal hardening through the rotary movement of the pump casing or with a fixed casing in the case of the flame hardening apparatus being moved along a circular path. This internal hardening makes the pump casing, through which abrasive materials are passed, wear-resistant, particularly for use in wet dredgers. Furthermore the service life of pump casings hardened in this way is much longer than that of the hitherto known pump casings.

BRIEF DESCRIPTION OF THE DRAWINGS

The invention is described hereinafter relative to nonlimitative embodiments and with reference to the attached drawings, wherein show:

FIG. 1 an apparatus with a rotating pump casing and with a fixed flame hardening burner viewed from above and with the upper pump casing cover partly removed.

FIG. 2 a side view of the apparatus of FIG. 1.

DETAILED DESCRIPTION OF THE PREFERRED EMBODIMENTS

Figure 3:
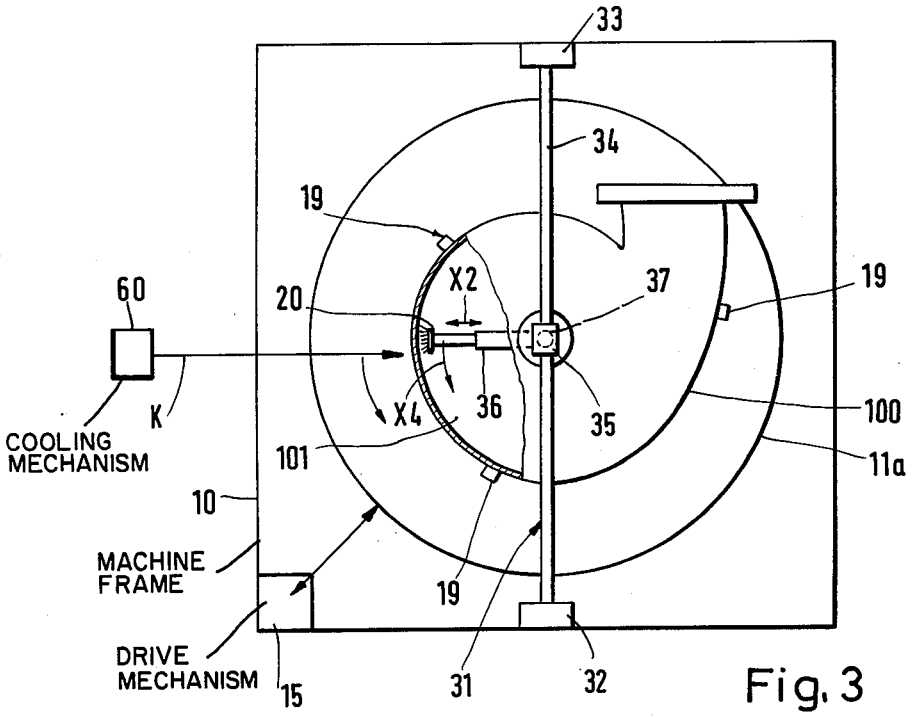
FIG. 3 a further embodiment of the apparatus with a fixed pump casing and with a flame hardening burner movable on a circular path corresponding to the arc radius of the pump casing viewed from above and with the pump casing cover partly removed.

The apparatus for the surface hardening of the inner surface of pump casings shown in FIGS. 1 and 2 comprises a machine frame 10 having a horizontally positioned supporting disc 11 which by means of a swivel joint, such as e.g. a ball and socket joint or the like 12 is connected to the machine frame 10 in such a way that supporting disc 11 can move to all sides in the direction of the arrows X, X1 (cf FIG. 2). The pivoting of supporting disc 11 out of its horizontal plane 14 takes place by means of a drive mechanism indicated at 15. In addition supporting disc 11 can be rotated about its vertical axis 18. Supporting disc 11 can be rotated by the drive mechanism 13. However, it is also possible to combine the drive mechanism 13 for the rotary driving of supporting disc 11 and the drive mechanism 15 for the disc movement into a single drive mechanism. Preferably supporting disc 11, rotatable about its vertical axis 18, is held on a bearing support 111 which is in operative connection with the drive mechanism 15 (FIG. 2).

On the top of supporting disc 11 retaining devices 19 are provided for the pump casing to be hardened. These retaining devices 19 are constructed as locking devices and may for example comprise clamping jaws so as to give the casings to be hardened an adequate hold, particularly during the rotation of the supporting disc 11.

The pump casing shown in FIGS. 1 to 5 is 100, its inner area 101 and its pressure connection 102, whilst its suction connection is indicated at 103.

For the surface hardening of the inner surface of a pump casing 100 the inner area 101 of casing 100 contains a flame hardening apparatus, comprising a flame hardening burner 20 fixed to the machine frame 10 and which is arranged in the inner area 101 of casing 100 in such a way that during the rotation of supporting disc 11 and consequently during the rotation of pump casing 100 the flames from the flame hardening burner 20 act on the inner wall of the casing.

Figure 5:
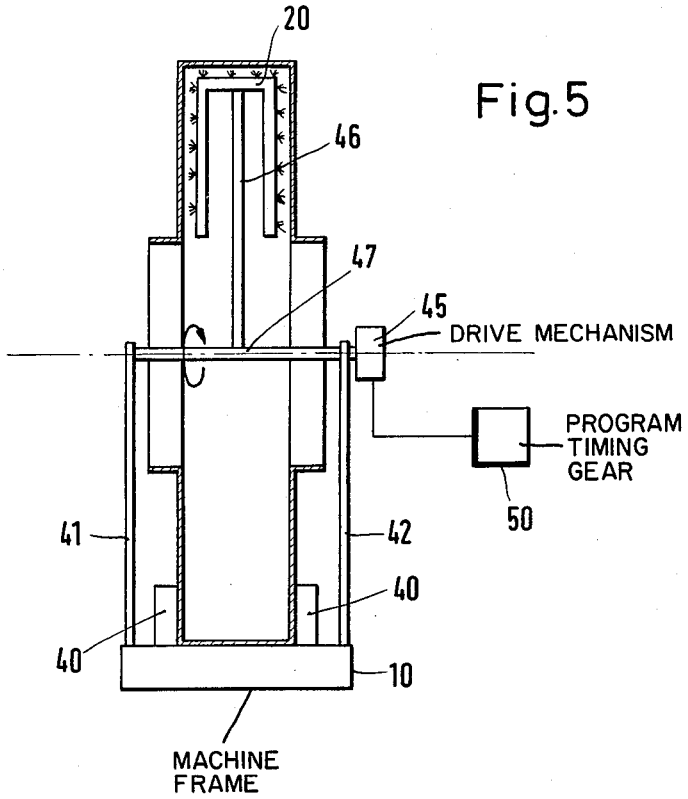
FIG. 5 the apparatus according to FIG. 4 partly in side view and partly in vertical section.

The flame hardening burner 20 corresponds to the internal cross-sectional profile of pump casing 100 and preferably has a U-shaped or circular profile, as indicated in FIG. 5. The flame hardening burner 20 has peripherally distributed flame outlet openings.

The support and guidance of the flame hardening burner 20 in inner area 101 of pump casing 100 is effected by means of a vertical supporting member 16 fixed to machine frame 10 and whose upper end **16*a* is bent in U-shaped manner, whereby it has a horizontal portion 16*b* and a vertical portion 16*c*. The end of supporting member portion 16*c* which is parallel to the supporting member 16 and runs in the direction of machine frame 10 has a horizontal retaining arm 17, whose free end carries the flame hardening burner 20. The retaining arm 17 receives the supply lines V for the flame hardening burner 20. The flame outlet openings arranged on the periphery thereof are formed in such a way that the flames escape in the direction of arrow Y and act on the inner wall surface of pump casing 100**.

The dimensions of the flame hardening burner 20 are such that when the pump casing passes through the flame hardening apparatus burner 20 slowly moves through the inner area of casing 100. Retaining arm 17 also has the feedlines for the supply of cooling water.

On machine frame 10 is also provided a cooling mechanism 60 which supplies cooling water K for cooling the outer wall surface of pump casing 100. This cooling mechanism 60 comprises a hydraulic main having a configuration corresponding to that of the outer profile of pump casing 100 and which is provided with cooling water discharge nozzles directed onto the outer wall of casing 100.

Since for example in the case of single-acting centrifugal pumps in spiral casings the rotation axis of the impeller does not coincide with the central axis of the suction connection it is necessary for the length of the retaining arm 17 for the flame hardening burner 20 to be variable so as to ensure that on directing the flame hardening burner 20 onto the inner wall of pump casing 100 the same spacing is maintained if the supporting portion **16*c* of supporting member 16 which carries the retaining arm 17 is not arranged centrally with respect to pump casing 100. In order to bring about a length compensation of retaining arm 17 the latter comprises at least two, preferably telescopically extendable and retractable portions 17*a*, 17*b*. The extension or retraction of both arm portions 17*a*, 17*b* takes place in the direction of arrow X2 (FIG. 1). In order to bring about the automatic length compensation the larger retaining arm portion 17*b* has a compression spring, which is not shown in the drawing, which forces arm portion 17*a* into the necessary position. To maintain the correct spacing between the flame hardening burner 20 and the inner wall of pump casing 100 to be treated burner 20 can be provided with spacers which are not shown in the drawings. The possibility also exists of using a differently constructed mechanism for the automatic length adjustment of the retaining arm 17 which ensures the maintenance of the necessary constant spacing between flame hardening burner 20 and the inner wall of pump casing 100**.

The apparatus for the surface hardening of the inner surface of pump casings shown in FIGS. 1 and 2 operates in the following manner. After fixing the pump casing 100 to be hardened to the supporting disc 11 flame hardening burner 20 is introduced into the inner area 101 of pump casing 100 either through the suction connection 103 of casing 100 or via the casing opening facing connection 103 for the passage of the drive shaft for the impeller by means of supporting disc portion 16. Supporting disc 11 is then rotated by means of drive mechanism 13 in the direction of arrow X3, so that the inner wall surface of pump casing 100 slowly passes flame hardening burner 20. To prevent any cooling water from entering the flame hardening area or the vicinity of not yet hardened wall portions of the pump casing, disc 11 with pump casing 100 arranged thereon is pivoted by means of drive mechanism 15 in such a way that the cooling water is removed from the flame hardening zone over already hardened inner wall areas of the casing to a point on the latter at which the cooling water can either be removed by suction or drained off, such as for example through the pressure connection or the suction connection, dependent on where the flame hardening burner 20 is introduced.

Whereas in the case of the apparatus according to FIGS. 1 and 2 pump casing 100 is slowly moved past a fixed flame hardening burner 20 in the embodiment shown in FIG. 3 burner 20 rotates, whilst pump casing 100 is fixed.

The apparatus for the surface hardening of the inner surface of pump casing shown in FIG. 3 also comprises machine frame 10 and supporting disc 11*a* connected to said frame by means of the swivel joint 12, said disc 11*a* also being provided with retaining devices 19 for pump casing 100. Supporting disc 11*a* is fixed, i.e. it is not rotated in the same way as supporting disc 11 in the apparatus according to FIGS. 1 and 2. However, like disc 11, disc 11*a* can be pivoted out of its horizontal plane 14 by means of drive mechanism 15. The flame hardening burner 20 arranged in the inner area 101 of pump casing 100 to be hardened is held on machine frame 10 by means of a bridge-like bearing support 31 and a vertical drive shaft 37, with the interpositioning of a swivel arm 36. The bridge-like bearing support 31 comprises vertical struts 32, 33 connected to machine frame 10 and which are interconnected by means of the horizontal strut 34 constructed as a supporting strut for a drive mechanism 35 with vertical drive shaft 37. Drive shaft 37 carries at its end the swivel arm 36, which again carries the flame hardening burner 20. Burner 20 is constructed in the same way as the burner described relative to FIGS. 1 and 2. A cooling mechanism 60 is once again connected to machine frame 10.

The apparatus shown in FIG. 3 functions as follows. After the pump casing 100 to be hardened has been fixed to the supporting disc 11*a* the flame hardening burner 20 is introduced into the inner area 101 of casing 100 and the drive mechanism 35 for drive shaft 37 or swivel arm 36 is put into operation, so that swivel arm 36 with burner 20 is moved in the direction of arrow X4 past the inner wall surface of pump casing 100. Preferably cooling mechanism 60 is arranged on a ring, which is not shown in the drawing and which is connected to the machine frame 10, whereby it is displaceable on said ring in order to always form a cooling zone on the outer surface of the casing 100 to be hardened wherever it is necessary.

Figure 4:
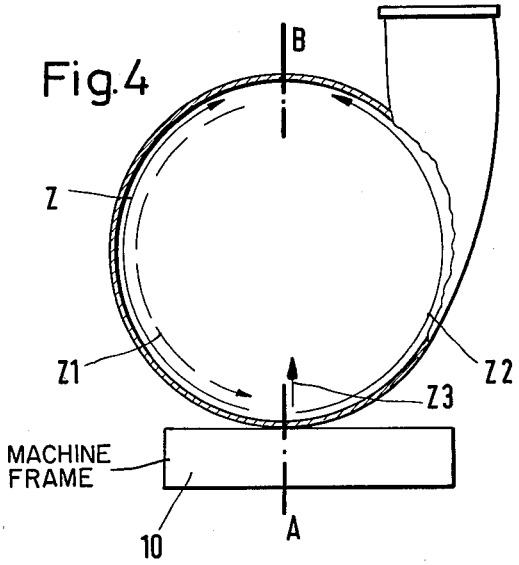
FIG. 4 an embodiment of the apparatus with a vertical fixed pump casing and with a movable flame hardening burner in side view.

Whereas in the case of the apparatus according to FIGS. 1 and 3 the pump casing to be hardened assumes a horizontal position during the hardening process FIGS. 4 and 5 show an embodiment of an apparatus for the surface hardening of the inner surface of pump casings in which the casing to be hardened assumes a vertical position. In the embodiment of FIGS. 4 and 5 the machine frame is again 10, whilst the retaining device for pump casing 100 is given the reference numeral 40. Machine frame 10 also has two spacedly arranged bearing supports 41, 42, which terminally carry a drive shaft 47 to which is fixed a swivel arm 46, which terminally carries the flame hardening burner 20. A drive mechanism 45 which performs the swivelling movement of swivel arm 46 with burner 20 is connected to drive shaft 47.

To prevent cooling water flowing into the flame hardening area or into the inner wall areas of the pump casing which have still not been hardened burner 20 is guided in the direction of arrow Z, Z1, Z2 (FIG. 4), its starting position being indicated by A. From starting position A flame hardening burner 20 is moved in the direction of arrow Z up to the upper end point B. During the movement of burner 20 in the direction of arrow Z the inner wall area of casing 100 which is passed by the flame hardening burner undergoes flame hardening. On reaching the upper position B the burner is rendered inoperative and is moved in the direction of arrow Z1 to the starting position A. From position A burner 20 is pivoted in the direction of arrow Z2 into the upper position B. During the passage in the direction of arrow Z2 the other inner wall area of the pump casing is hardened. The movement sequences of burner 20 are controlled by means of a drive mechanism 45 and a program timing gear 50 connected therewith. The removal by suction of the cooling water from inner area 101 of pump casing 100 takes place in the direction of arrow Z3.

A corresponding control of the position of the pump casing 100 to be hardened also occurs with the apparatus of FIGS. 1 and 3. Here again drive mechanisms 13 and 15 are combined in a program timing gear which controls both the rotation of supporting disc 11 and the movement of the disc, as a function of the position of burner 20, so that a completely satisfactory removal of the cooling water from the flame hardening zone is ensured without said water reaching those areas of the inner wall of casing 100 which have not yet been hardened. In the apparatus of FIG. 3 the drive mechanism 35 pivoting flame hardening burner 20 is combined with drive mechanism 15 for moving the disc in a common control mechanism. The control mechanisms can be constructed as programme timing gears.

The invention is not limited to the embodiments described and represented hereinbefore and various modifications can be made thereto without passing beyond the scope of the invention.

What is claimed is:

1. A process for the continuous hardening of pump casings which during use have a vertical axis and the casing having an arcuately shaped inner area generally encircling the vertical axis in an eccentric manner, the inner area may have an internal plating and depending on the hardening being effected the core characteristics of the material forming the inner area may be changed, by flame hardening the inner surface of the inner area of the casing with a flame hardening burner including the steps of moving the pump casing relative to the flame hardening burner past the flame hardening burner with the relative movement being about the vertical axis, directing cooling water against the inner surface of the inner area after the exposure of the inner area to the flame hardening burner and simultaneously moving the pump casing for removing the cooling water from the pump casing by flowing the cooling water directed against the inner surface of the inner area over the inner surface already exposed to the flame hardening step.

2. A process according to claim 1, including the step of maintaining the distance between the inner surface of the inner area of the pump casing and the flame hardening burner constant.

3. A process according to claim 1, including the step of simultaneously cooling the outer surface of the pump casing at the particular point the inner surface of the inner area of the pump casing is being heated by the flame hardening burner.

4. A process, according to claim 1, including the step of supporting the pump casing with the vertical axis thereof extending vertically, supporting the pump casing in the horizontal position, and displacing the pump casing out of the horizontal position for removing the flow of cooling water.

5. A process for the continuous hardening of pump casings which during use have a vertical axis and the casing having an arcuately shaped inner area generally encircling the vertical axis in an eccentric manner, the inner area may have an internal plating and depending on the hardening being effected the core characteristics of the material forming the inner area may be changed, by flame hardening the inner surface of the inner area of the casing with a flame hardening burner including the steps of holding the pump casing in a stationary horizontal position on pump casing support means with the vertical axis thereof being positioned vertically and moving the flame hardening burner past the stationary inner surface of the inner area of the casing, directing cooling water against the inner surface of the inner area after the exposure of the inner area to the flame hardening burner and displacing the pump casing support means out of the horizontal position with the pump casing being held stationary relative to the pump casing support means for removing cooling water via the already hardened inner surfaces.

6. A process for the continuous hardening of pump casings which during use have a vertical axis and the casing having an arcuately shaped inner area generally encircling the vertical axis in an eccentric manner, the inner area may have an internal plating and depending on the hardening being effected the core characteristics of the material forming the inner area may be changed, by flame hardening the inner surface of the inner area of the casing with a flame hardening burner, holding the pump casing in a vertical position with the vertical axis thereof arranged horizontally, moving the flame hardening burner from a position opposite the lowest point of the vertically arranged pump casing over the inner surface of the inner area of the casing through approximately 180° to the highest point of the vertical pump casing, switching off the flame hardening burner and returning the flame hardening burner over the same path back to the lowest point of the vertically arranged pump casing, switching on the flame hardening burner and moving the flame hardening burner from the lowest point in the same direction in which the flame hardening burner had been moved to the lowest point from the highest point and guiding the flame hardening burner over the inner surface of the inner area of the pump casing to the highest point of the inner surface for completing the flame hardening of the inner surface whereby in each of the flame hardening steps the flame hardening burner is moved through approximately 180°.

* * * * *